United States Patent [19]

Smith

[11] 3,990,669

[45] Nov. 9, 1976

[54] COLLAPSIBLE SUPPORT STRUCTURE OR EASEL

[76] Inventor: Donald B. Smith, R.R. No. 1, Mount Brydges, Ontario, Canada, N0L 1W0

[22] Filed: Apr. 28, 1975

[21] Appl. No.: 572,410

[52] U.S. Cl. ..... 248/459

[51] Int. Cl.[2] ..... F21K 2/021

[58] Field of Search ..... 248/174, 450, 459, 460

[56] References Cited

UNITED STATES PATENTS

| | | | |
|---|---|---|---|
| 433,635 | 8/1890 | Turck | 248/459 X |
| 844,066 | 2/1907 | Warren | 248/459 |
| 1,875,460 | 9/1932 | Holy | 248/450 |
| 2,587,316 | 2/1952 | Henry | 248/459 |
| R21,371 | 2/1940 | Barrett | 248/460 X |

*Primary Examiner*—William H. Schultz

[57] ABSTRACT

This invention relates to a light-weight collapsible support structure such as an easel which is self-sustaining in a predetermined configuration when unfolded and extended to sit upon a flat surface and presents three forwardly facing inclined panels, a central inclined panel flanked by two inclined side panels hingedly connected thereto to extend angularly outwardly therebeyond at each side to provide at least three surfaces in side by side relation and forming a partial enclosure, and upon which surfaces material may be mounted or supported, or such structure might also serve as a book support and cover, the three forwardly facing panels being supported rearwardly by an integral upstanding central plane hingedly connected only along its upper edge to the upper edge of the forwardly facing central inclined panel and tied or secured to the two inclined side panels to stabilize the configuration, all four panels being so hingedly connected together that the structure may upon being unfolded extend into its self-sustaining predetermined configuration and may be compactly folded up when collapsed for storage or for carrying.

12 Claims, 14 Drawing Figures

COLLAPSIBLE SUPPORT STRUCTURE OR EASEL

FIELD OF INVENTION

This invention relates to a lightweight collapsible support structure that provides adjacent inclined surfaces for supporting articles to be displaced, viewed or worked upon, as in the case of an easel, and also useful as a shield to define or enclose a study or work station.

OBJECTS OF THE INVENTION

The principal object of this invention is to provide a self-sustaining lightweight collapsible support structure of the type described adapted upon being extended from a flattened or folded state to assume an independently erect stable configuration when set upon a flat supporting surface.

Another important object is to provide a collapsible support structure of the type described which folds compactly for carrying or for storing and upon being extended, automatically assumes an independently erect stable configuration.

Still another important object is to provide a support structure which serves additionally as the storage unit or protective cover for work to be displayed, or viewed, or worked upon, when the unit is dismantled or folded upon.

Another object is to provide an article support of structural simplicity easily manipulated from its folded or flattened state into its independently erect stable configuration.

Still another important object is to provide a support structure which can be produced in a variety of forms adapted for particular uses, yet have, in each form, an overall configuration that is pleasing in appearance.

Still another very important object is to provide a support structure capable of being fabricated from low cost lightweight materials using fundamental manufacturing steps and apparatus requiring low labour content.

FEATURES OF THE INVENTION

The principal feature of this invention resides in providing a support structure derived from an assembly of at least four substantially rigid sheet-like panels, hingedly connected together along their common abutting edges to define fold axes for swinging movement towards and away from each other as the structure is folded up or unfolded respectively, the structure presenting an arrangement of at least three forwardly facing inclined panels when erected, including a central panel flanked by a pair of side panels, each side panel being adapted to swing about its respective fold axis with the central panel forwardly and outwardly thereof and in angled relation thereto to a limit position wherein the lower edges of the three forwardly facing panels are in support surface engaging relation, the forwardly facing central panel, being hingedly supported in inclined relation, adjacent its upper edge by a rear central panel, adapted to swing about its respective fold axis with the forwardly facing central panel rearwardly, to a limit position, with the rear central panel upstanding and the lower edge thereof in support surface engaging relation, the rear panel and each side panel respectively being adapted to be secured by ties extending therebetween upon reaching their respective limit position to constrain them against further separation, whereby the hingedly interconnected panels are stabilized on assuming a fully erect configuration.

More particularly, it is a feature to provide ties in the form of substantially rigid sheet-like gussets hingedly connected to the rear panel for swinging movement about spaced substantially parallel fold axes, the fold axes of the respective gussets lying in a substantially common plane with the fold axes of the respective forwardly facing side panels and each gusset being hingedly connected to its respective side panel about a fold axis lying substantially within the plane of such side panel and with the later mentioned fold axis of the gusset intersecting with the first mentioned fold axis of such gusset, whereby all hingedly interconnected panels are swingable together from a folded position to an extended erect position wherein the separation of the panels is automatically limited and the structure stabilized.

Another feature resides in selecting a configuration and dimensions of centrally located panels and associated side panels such that the associated side panels can interleave in compact overlying relation to the centrally located panels when collapsed for carrying or for storing same.

Still another feature resides in providing a support structure in which the perimetral configuration of the centrally located forwardly facing panel can be varied throughout a range of quadrilateral outlines to provide alternatives, for example where the support structure would be used for display purposes as distinguished from the case where the support structure would be used as a jacket or support for a book in which the central panel would take the form of an elongated rectangle.

Still another feature resides in providing a double hinge formation between each associated side panel and gussets and their respective centrally located front and rear panels to accommodate thicknesses of notebooks, or pads, or other materials adapted to be supported upon the forwardly facing inclined surfaces when the structure is folded up for storage or for carrying to another location.

Still another important feature of the invention resides in providing a support structure derived from substantially rigid sheet-like panels, having a configuration and arrangement such they can be struck from a flattened sheet of material in a single die-cutting operation which also impresses or scores the sheets with the integral fold axes to define the several hinge connections.

These and other objects and features appear in the following description to be read in conjunction with the drawings.

THE DRAWINGS

DESCRIPTION OF THE INVENTION

Figure 1:
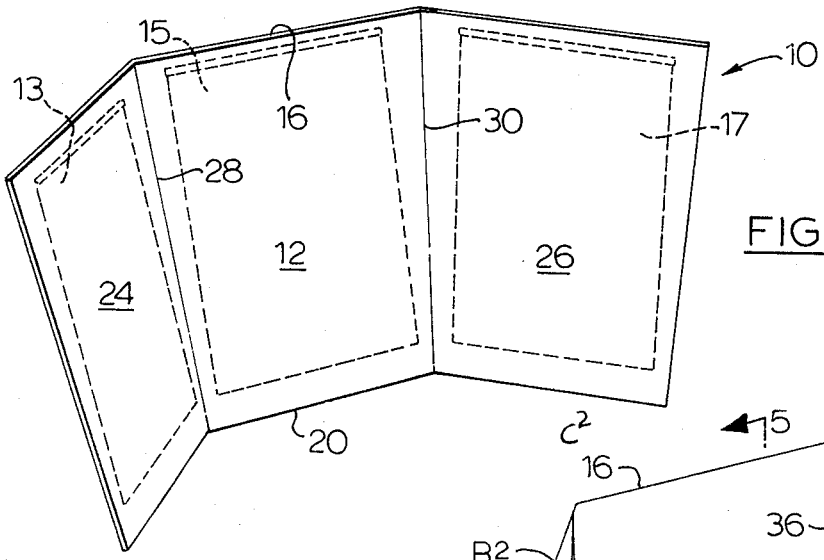
FIG. 1 is a perspective view taken from a point above and to one side of a support structure embodying the invention in the fully extended erect stable position, illustrating an arrangement of three forwardly extending inclined supporting surfaces.
Figure 3:
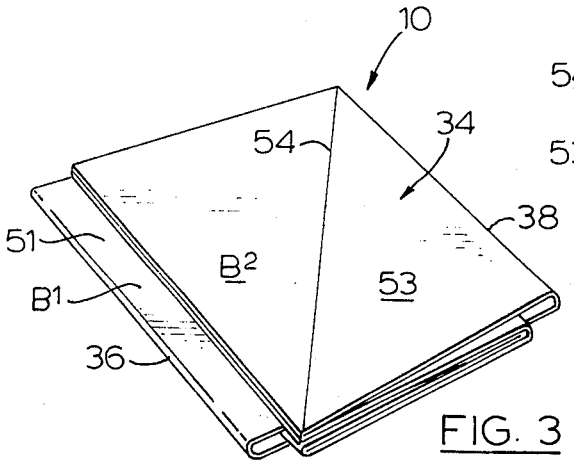
FIG. 3 is a perspective view of the support structure of FIGS. 1 and 2 with the extended outermost side panels folded over each other and upon the central panels, illustrating the fully collapsed position for storage or for transporting same.
Figure 7:
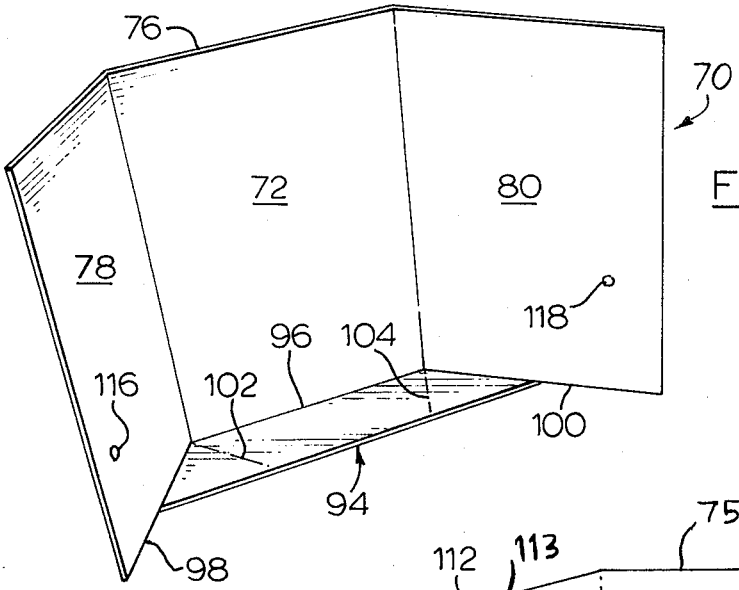
FIG. 7 is a perspective view of the modified structure of FIG. 6, taken from a point forwardly and upwardly to reveal the arrangement of the three forwardly inclined supporting surfaces in the fully extended erect stable position.

The embodiments of the support structure shown in the extended preferred configurations of FIGS. 1 and 7 respectively, when erected on a plate surface are independently stable or self-sustaining yet fold compactly as illustrated by FIG. 3 into a substantially planar configuration for carrying or for storing.

Figure 9:
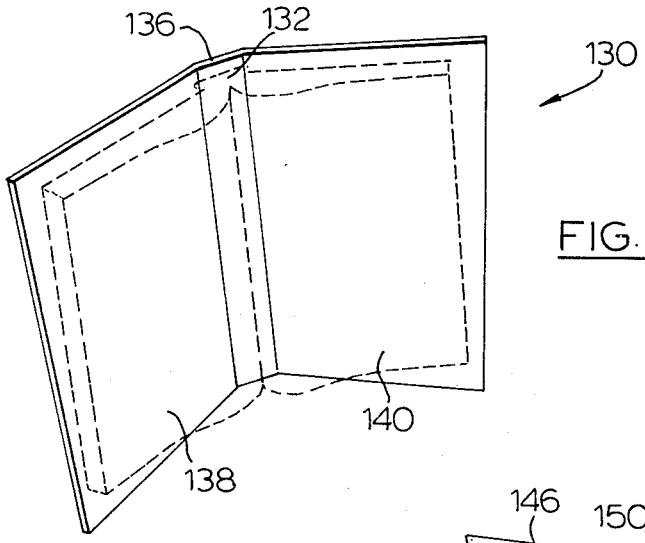
FIG. 9 is a perspective view taken from a point forwardly and above a further modified support structure embodying the invention, illustrating still another arrangement of three forwardly extending inclined supporting surfaces in the fully extended erect stable position.

The preferred embodiment of FIG. 9 folds together in the manner of the hard back covers of a book, yet when extended, will stand independently erect and stable on a flat surface.

All embodiments disclosed may be cut and folded from a single sheet of suitable material, such as a strong stiff cardboard. The panels, also, may take the form of rigid inserts encased in heat-sealable plastic sheeting with the respective fold axes in such alternative defined by selected thicknesses of such plastic sheeting.

Requisite panels giving rise to the support structure in the case of cardboard are impressed or inscribed into a sheet in the die-cutting operation with the common edges defining fold axes and where panels are adapted to be joined, the connection is made by glue or by suitable fasteners such as wire staples or metal eyelets.

In the case of reinforced plastic panels, the connection can be made by heat seals or by snap-fasteners.

Still other alternatives may be substituted in the case of large supports or enclosures to provide the peripheral rigidity that characterizes a panel. For example a tubular structure may be selected taking the form of frames suitably braced and encased in fabric if desired. There may well be other combinations of substantially rigid struts in combination with other suitable material to give rise to the attributes of strength that a substantially rigid panel element would possess in the light of the invention to be described and claimed.

The term sheet-like panel is intended to embrace articles or structures that possess corresponding attributes of the particular sheet material described in the preferred embodiments.

THE EMBODIMENT OF FIGS. 1 to 5 INCLUSIVE

Figure 2:
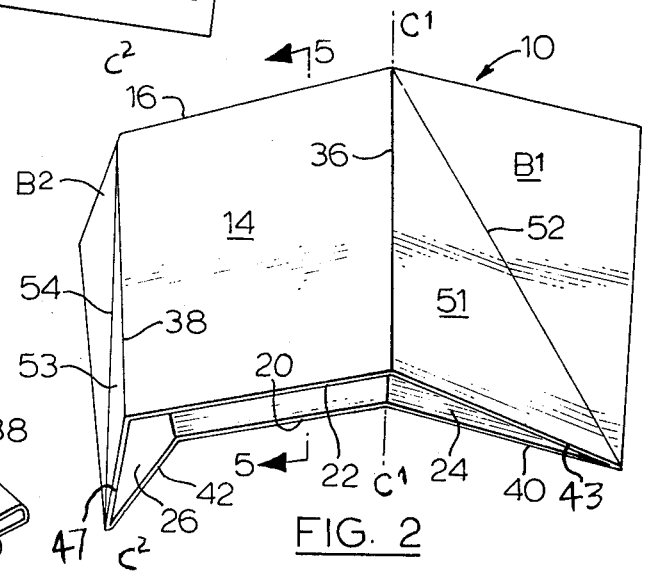
FIG. 2 is a perspective view taken from a point to the rear and below the support structure of FIG. 1 to reveal the relationship of the several panels comprising the support structure and the configuration of the lowermost edge formations in the fully extended erect stable position.
Figure 4:
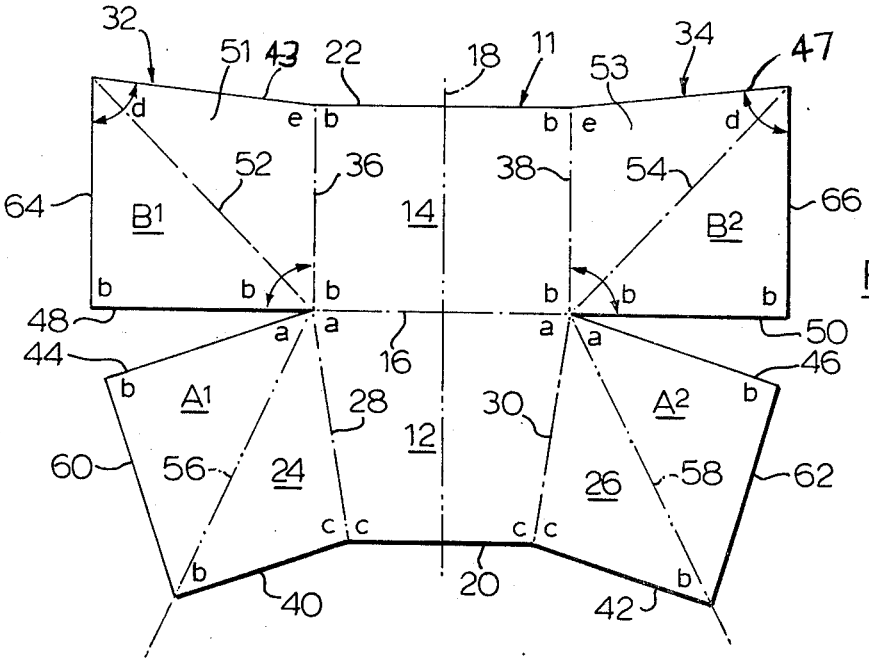
FIG. 4 is a plan view of a flattened sheet of suitable material having a perimetral configuration and impressed or inscribed integral fold axes from which the support structure of FIGS. 1, 2 and 3 is derived.

Support structure 10 illustrated in FIGS. 1 to 3 inclusive and 5 of the drawings is preferably derived from the one-piece layout 11, cut and folded from a suitable sheet of material illustrated in FIG. 4.

Centrally located front inclined panel 12 of the embodiment is adapted to be supported from the upper edge of upstanding rear panel 14 by a hinge connection having a horizontal axis as at 16 for swinging movement first forwardly from a folded position inclined to the horizontal downwardly from the upper edge of rear panel 14, and then reversely when the structure is to be collapsed.

The hinge connection at 16 in the case of cardboard sheeting as earlier explained can be defined by a line of compression or a score line imparted to the sheet in the die cutting operation and suitably reinforced, if desired, with adhesive tape or other fabric backing.

Centre line 18 shown in FIG. 4 bisects hinge connection 16 and constitutes an axis of symmetry of layout 11.

Edge 20 of inclined front panel 12 is located a greater distance measured along centre line 18 from fold axis 16 than edge 22 of upstanding rear panel 14 in order to provide the inclined relationship of front panel 12 to rear panel 14 in the erect configuration, but both edges extend in substantial parallel relation to each other and to fold axis 16 to provide stability.

Figure 5:
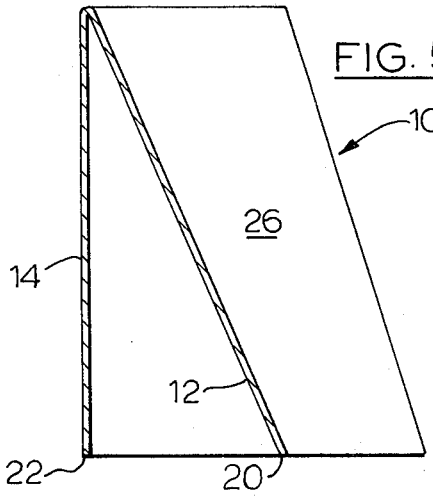
FIG. 5 is a view in vertical cross section of the illustrating support structure shown in FIG. 2, taken along the lines 5—5 of FIG. 2.

Flanking inclined front panel 12 is a pair of inclined side panels, 24, 26, of opposite symmetry, hingedly connected respectively on opposite sides along their common edges as at 28, 30, by lines of compression or by scoring the sheet as explained to provide a pair of spaced inclined fold axes adapted for swinging movement of panels 24, 26 toward and away from inclined front panel 12, either to take up the extended position illustrated in FIGS. 1, 2 and 5 with inclined side panels extending angularly outwardly beyond the central front panel 12, when the structure is fully erect or folded in interleaved relation illustrated in FIG. 3 when the structure is collapsed.

Likewise, upstanding rear panel 14 is flanked by a pair of side panels 32, 34 of opposite symmetry hingedly connected at opposite sides along common edges 36, 38, to define a pair of spaced upstanding fold axes likewise adapted for swinging movement of such panels towards and away from upstanding rear panel 14 and in overlying relation to side panels 24, 26 as shown in FIG. 3.

One set of dimensions for support structure 10 illustrated in FIGS. 1 to 5 inclusive is as follows:

Selected angle *a* of panels 12, 24 and 26 is acute.

Angle *b* on all panels is of the order of 90°.

Angle *c* on all panels is of the order of 180°, less the value of angle *a*.

Angles *d* and *e* are variable and depend on the selected lateral dimensions of side panels 32, 34.

The dimensions of inclined side panels 24, 26 of the embodiment of FIGS. 1 to 5 inclusive are selected so that panels 24, 26 may interleave as they are folded over panel 12 illustrated in FIG. 3.

Likewise, the selected dimensions of upstanding rear panel 14 and side panels 32, 34 must be such in relation to panels 12, 24 and 26 as to facilitate the folding action of the associated panels and the collapsing of the structure as represented by FIG. 3.

Edges 40, 44 of side panel 24 and edges 42, 46 of side panel 26 are substantially parallel.

Edges 44, 46 of side panels 24 and 26 respectively correspond in length to edges 48, 50 of rear side panels 32, 34 respectively.

Edges 43, 47 of rear side panels 32, 34 are angled slightly upwardly to accommodate a variation in the vertical disposition of the rear panel 14.

Each of rear side panels 32, 34 are provided with diagonal fold lines 52, 54 respectively, adapted to register with diagonal 56 and diagonal 58 (shown in broken outline) of inclinded side panels 24, 26, respectively, when presented to the rear surface of the latter panels when layout 11 is folded up to assume the erect outline of FIGS. 1, 2 and 5.

Edges 60, 62 of inclined panels 24, 26 correspond in length to edges 64, 66 of rear side panels 32, 34 respectively, so that triangular portions $B^1$ and $B^2$ of side panels 32, 34 are in full registration with triangular portions $A^1$ and $A^2$ of inclined side panels 24, 26 when arranged in abutting relation to assume the outline of FIGS. 1, 2 and 5.

Triangular portions $A^1$ and $B^1$ and $A^2$ and $B^2$ are adapted to be securely fastened together by glue or by wire staples or combinations of fasteners thereby reinforcing and rigidifying front panels 24, 26 with the intermediate gusset portions 51 and 53, swingably supporting front panels 24, 26 from and securing them to upstanding rear panel 14 to provide against further separation in the extended erect configuration.

The arrangement described allows for swinging movement of the now composite side panels 24, 32 and 26, 34 about their respective pairs of fold axes 28, 36 and 30, 38 because, having regard to the selected dimensions, those cooperating pairs of fold axes 28, 36 and 30, 38 each lie substantially within a common plane for swinging movement as indicated in $C^1$ and $C^2$ respectively in FIG. 2.

With the several panels of layout 11 of FIG. 4 folded up and secured together to provide the outline of support structure 10, when extended, will stand independently erect and assume a stable configuration under loading, yet fold up into the compact configuration of FIG. 3 upon movement of the composite side panels forwardly.

Shown in broken outline in FIG. 1, supported upon each of forwardly inclined surfaces of panels 12, 24 and 26 are loose leaf pads 13, 15 and 17, having hard covers and a ring-coil binding them together along the top edges respectively.

The loose sheet material of pads 13, 15 and 17 is adapted to be suspended from the top edges of the respective panels by flipping the front hard cover of the pads over the top edges to dispose ring-coils along the upper edges and with the top cover hanging rearwardly downwardly of the rear surfaces.

With such an arrangement, the pages of the notebooks can be examined or worked upon and then flipped up and over the top edge of its respective panel to reveal the next and subsequent pages.

Other alternatives may be used to attach different sheet material to inclined surfaces, for example, by staples, pins adhesive tape or clips.

It will be observed from FIG. 2 particularly, and also from FIG. 5 that in the fully extended independently erect configuration, the lower edge formations of the respective panels hingedly connected together, 20, 40 and 42, and 22, 43 and 47, are spaced apart and are in surface engaging relation throughout their extent.

It will be possible to have scalloped lower edges to give spaced point support as opposed to full edge support, if a different appearance is desired, but such extended surface engaging relationship must be established to achieve the desired stability.

THE EMBODIMENT OF FIGS. 6 TO 8 INCLUSIVE

Figure 6:
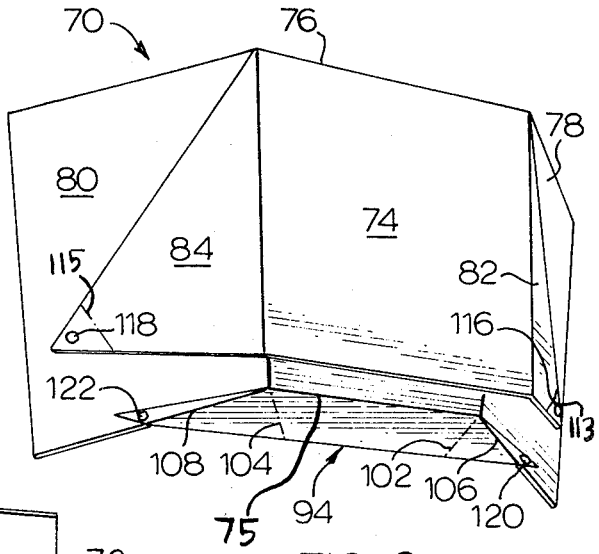
FIG. 6 is a perspective view of a modified support structure embodying the invention, taken from a point to the rear and below such modified support structure with the side panels in the fully extended erect stable position.
Figure 8:
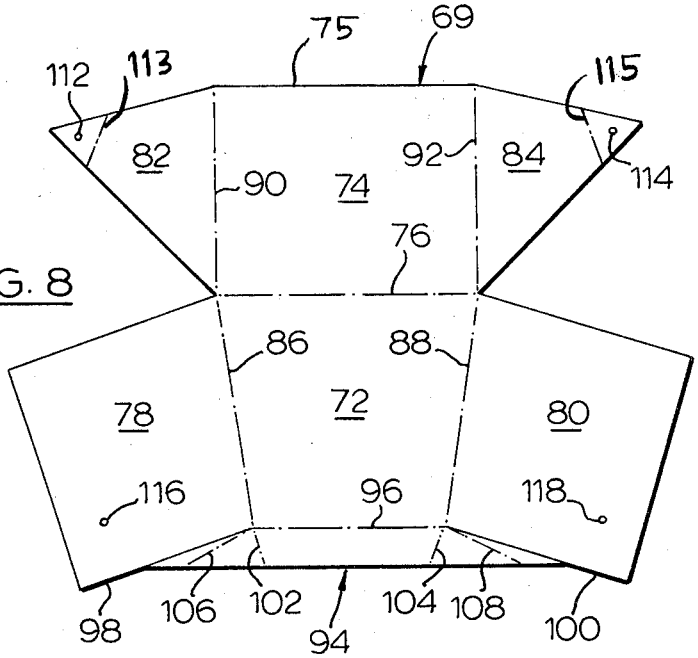
FIG. 8 is a plan view of a flattened sheet of suitable material, similar to FIG. 4, having a perimetral configuration and integral fold axes from which the embodiment illustrated in FIGS. 6 and 7 is derived.

It will be understood, having regard to the embodiment of the invention illustrated in FIGS. 6 to 8 inclusive, that a modification to the pattern or layout 11 of FIG. 4 may be undertaken without departing from the concept inherent in FIGS. 1 to 5.

Layout 69 shown in FIG. 8, giving rise to the embodiment 70 illustrated in its independently erect stable configuration in FIGS. 6 and 8 comprises a centrally located inclined front panel 72 supported rearwardly upon upstanding rear panel 74 hingedly connected along their common upper edges as at 76.

Flanking inclinded front panel 72 are side panels 78, 80 of opposite symmetry and if compared with the quadrilateral panel configuration of upstanding rear side panels 32, 34 of layout 11 of FIG. 4, upstanding rear panel 74 of FIG. 8 is provided only with flanking triangular panels 82, 84, constituting a gusset portion whose utility corresponds to the gusset portions 51 and 53 of the earlier mentioned panels 32, 34.

The common edges 86, 88 and 90, 92 are compressed or scored to constitute cooperating fold axes in the manner explained in connection with the embodiment of FIGS. 1 to 5 inclusive.

In contrast, an additional lower panel, 94, in provided, hingedly connected to central inclined panel 72 along their lower common edge at 96 and severed or separated from flanking inclined side panels 78 and 80 along their common lower edges at 98 and 100 respectively.

Located within the extent of lower panel 94 are opposite pairs of fold axes 102, 104 and 106, 108 utilized in the erection of support structure 70 from a compact folded position corresponding to that illustrated in FIG. 3 to the independently erect stable configurations illustrated in FIGS. 6 and 7.

As in the case of support structure 10 in support structure 70, forward panel 72 is adapted to be swung about fold axis 76 from a position in overlying relation to upstanding rear panel 74 forwardly to provide an upright inclined panel extending downwardly therefrom to the horizontal.

Side panels 78 and 80 move from a position in overlying relation with front panel 72 by swinging about the respective fold axes 86 and 88 to assume the angular outward disposition revealed in FIG. 7.

Rear triangular panels 82, 84 are each provided with a suitable component of a fastener as at 112 and 114 respectively and provided with fold axes as at 113 and 115 respectively in order to cooperate with the other components of such fasteners located within the perimeters of inclined side panels 78, 80 as at 116 and 118 respectively.

The remote portions of panel 94 beyond the outermost fold lines 106 and 108 are likewise provided with a component of a suitable fastener as at 120 and 122, adapted to interengage with the corresponding component of its respective fastener (not shown) located adjacent lower surface engaging edges 98, 100 of inclined side panels 78, 80.

Panels 82 and 84 join panel 94 to inclined side panels 78 and 80 in the extended erect position to thereby constrain all panels against further separation and because of the presentation of lower edge 75 of rear panel 74 in a horizontal plane common to the plane of the supporting surface that includes lower edges 96, 98 and 100 of the first mentioned panels, stability of the structure in the erect configuration is achieved.

The reduction of upstanding rear side panels 82, 84 to a triangular configuration, corresponding to the gussets of the embodiment of FIGS. 1 to 5 constitutes a saving of material where for example reinforced plastic panel construction is adopted, or where for example the components are intended to be disconnected and stored in a flattened state as opposed to the folded state.

The provision of surface engaging panel 94 establishes friction contact for the lower edge of an article such as a book, to be supported, with the book resting on the surface without sliding forwardly as will be its tendency where the supporting surface is smooth.

It is possible where support structures such as those indicated at 10 in FIG. 1 and at 70 in FIG. 6 are to be used in support of several articles, such as notebooks, to provide for the compact folding and carrying of the supported material, as well. In such modification the common fold axes may be constituted by a double hinge formation illustrated in FIG. 12 of the drawings.

THE MODIFICATION OF THE HINGE FORMATION

To illustrate, instead of providing for a single fold line as appears in the layout 11 of FIG. 4, a narrow panel, 124, 126 can be substituted defined by a pair of spaced fold lines as at 124*a*, 124*b*, 126*a*, 126*b*.

Likewise, rear panels 14, 32 and 34 are provided with corresponding narrow panels, 127, 129, defined by spaced fold lines 127*a*, 127*b*, 129*a*, 129*b*.

Figure 12:
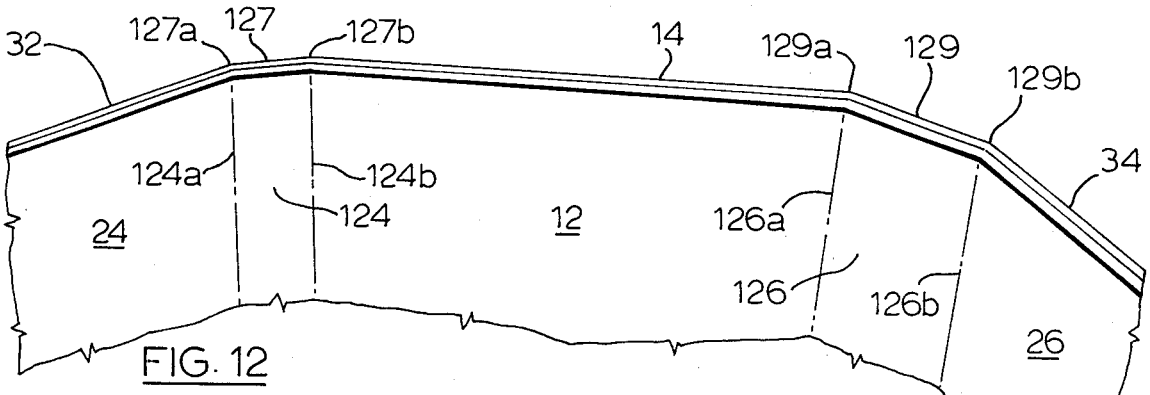
FIG. 12 is an enlarged perspective view of the upper edge formation, partly broken away, of a modified support structure having the general character of all preceeding embodiments but including a typical double hinge formation joining the respective central and side panels.

The perspective view illustrated in FIG. 12 showing the modification of double hinges as applied to the embodiment of FIGS. 1 to 5 indicates that when composite panels 24, 32 are folded, only two thicknesses of supported notebooks 13 and 15 are to be accommodated, whereas in the case of composite panels 26 and 34 three thicknesses of notebooks, 13, 15 and 17, and the thickness of composite panels 24 and 32 must be accommodated.

This arrangement calls for giving appropriate width dimensions to the narrow panels 124, 127 and 126, 129, with the latter pair having a greater width dimension than the former, if desired.

Accordingly, with the modified structure shown in FIG. 12 the utility of the support structure may be enhanced.

Figure 10:
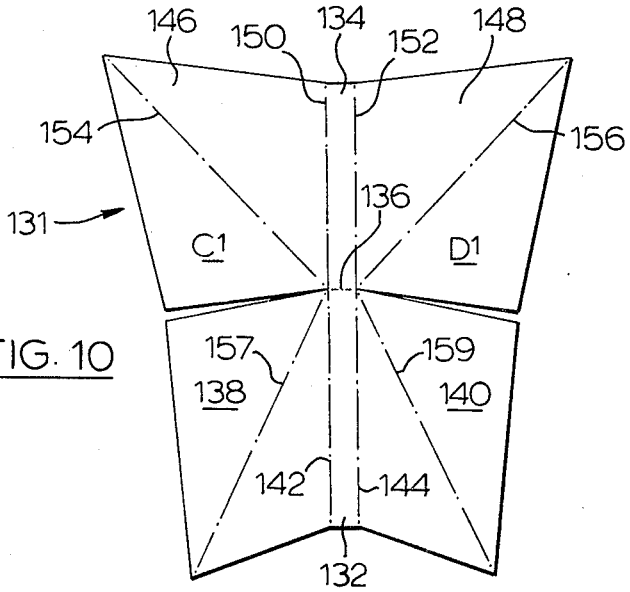
FIG. 10 is a plan view of a flattened sheet of suitable material, having a perimetral configuration and integral fold axes from which the embodiment of FIGS. 9 and 10 is derived.
Figure 11:
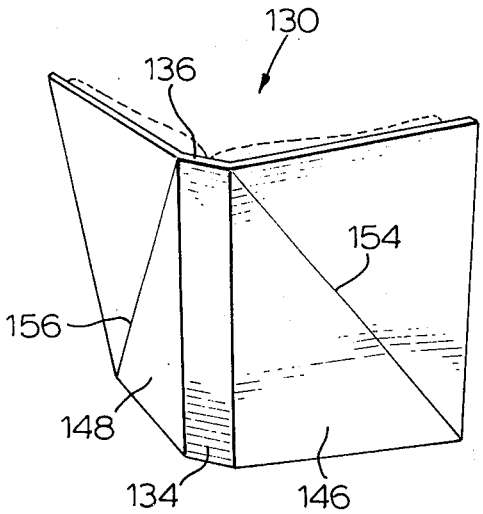
FIG. 11 is a perspective view of the embodiment of FIG. 9 taken from a point to the rear and above, revealing the relationship of the several rear panels in such position.

THE EMBODIMENT OF FIGS. 9 to 11 INCLUSIVE

In FIGS. 9 to 11 inclusive, still another embodiment of the invention is disclosed. This embodiment is designed specifically to support a book and may, if attached to the book covers serve as the permanent jacket for the book, when it is returned to the bookshelf.

Reference books particularly, are usually large and often unwieldy. Therefore, it will be advantageous to have a ready means for supporting them in inclined relation. The embodiment of FIGS. 9 to 11 indicated at 130 is intended to serve that function.

The pattern or layout 131 of FIG. 10, giving rise to the support structure 130 includes a central inclined panel 132 of rectangular outline, a rearward upstanding panel 134 of corresponding outline, hingedly connected along their common upper edges as at 136 centrally for swinging movement forwardly and reversely as in the manner already described.

Forwardly inclined central panel 132 is flanked by inclined side panels 138, 140, hingedly connected thereto along their common side edges 142, 144 respectively.

upstanding rear panel 134 is likewise flanked by side panel 146, 148, hingedly connected along their common side edges as at 150, 152 respectively and each provided with diagonal fold lines 154, 156 to register with corresponding diagonals 157, 159 of forwardly inclinded side panels 138, 140, to be joined thereto in the manner already described by wire staples or other suitable fastener.

It is to be understood the angle of inclination of the inclined panels to be assigned to any particular embodiment can be determined by selecting the appropriate dimensions and angles of the particular panels.

Moreover, the central inclined panels of the several embodiments can take the form of a trapezoid as revealed in the embodiments of FIGS. 1 to 8 inclusive or take the form of a rectangle as shown in FIGS. 9 to 11.

THE EMBODIMENT OF FIG. 13

Figure 13:
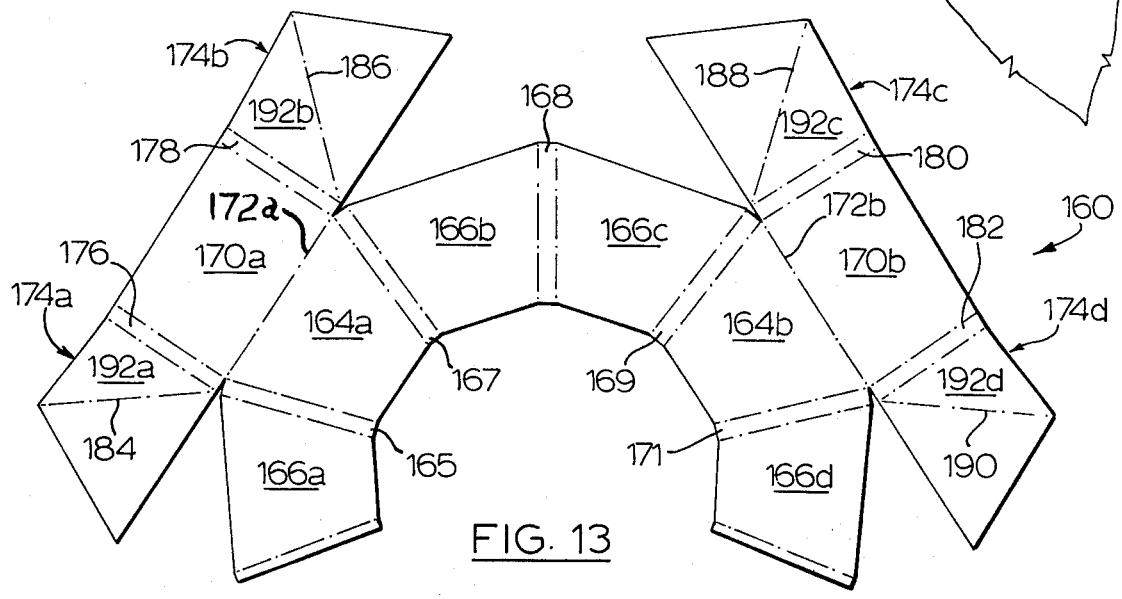
FIG. 13 is a plan view of a flattened sheet of suitable material, having a perimetral configuration and integral fold axes from which multiple units patterned on the embodiment of FIGS. 1 to 5 may be derived.

Layout 160 of FIG. 13 is derived from layout 11 of FIG. 4.

According to the illustration in FIG. 13, a support structrue presenting six inclined panels inwardly can be folded up from layout 160.

Such modified support presents opposed centrally inclined front panels 164*a*, 164*b*, each flanked by a pair of inclined side panels 166*a*, 166*b*, 166*c*, 166*d* respectively.

The several inclined panels are joined by a double hinge formation of the type described in relation to FIG. 12 along their common edges as at 165, 167, 169 and 171.

Adjacent side panels 166*b*, 166*c*, are joined together along their common edges by still another double hinge formation as at 168.

Each central inclined front panel 164*a*, 164*b* is adapted to be supported from the upper edge of upstanding rear panels 170*a*, 170*b* along their common upper edges as at 172*a*, 172*b*.

Similarly, flanking upstanding rear panels 170*a* 170*b* are pairs of upstanding rear side panels, 174*a*, 174*b* and 174*c* and 174*d* respectively, carried for swinging movement about double hinge formations along their common edges as at 176, 178, 180 and 182 respectively.

As in the case of the embodiment illustrated in FIG. 4, rear side panels are also provided with the diagonal fold lines 184, 186, 188 and 190, adapted to register with and be secured to the inclined front panels, all in the manner described with gusset portions 192*a*, 192*b* and 192*c* and 192*d* controlling the movement and supporting the forward inclined side panels in the multiple unit in the same fashion as in the single unit.

THE EMBODIMENT OF FIG. 14

Figure 14:
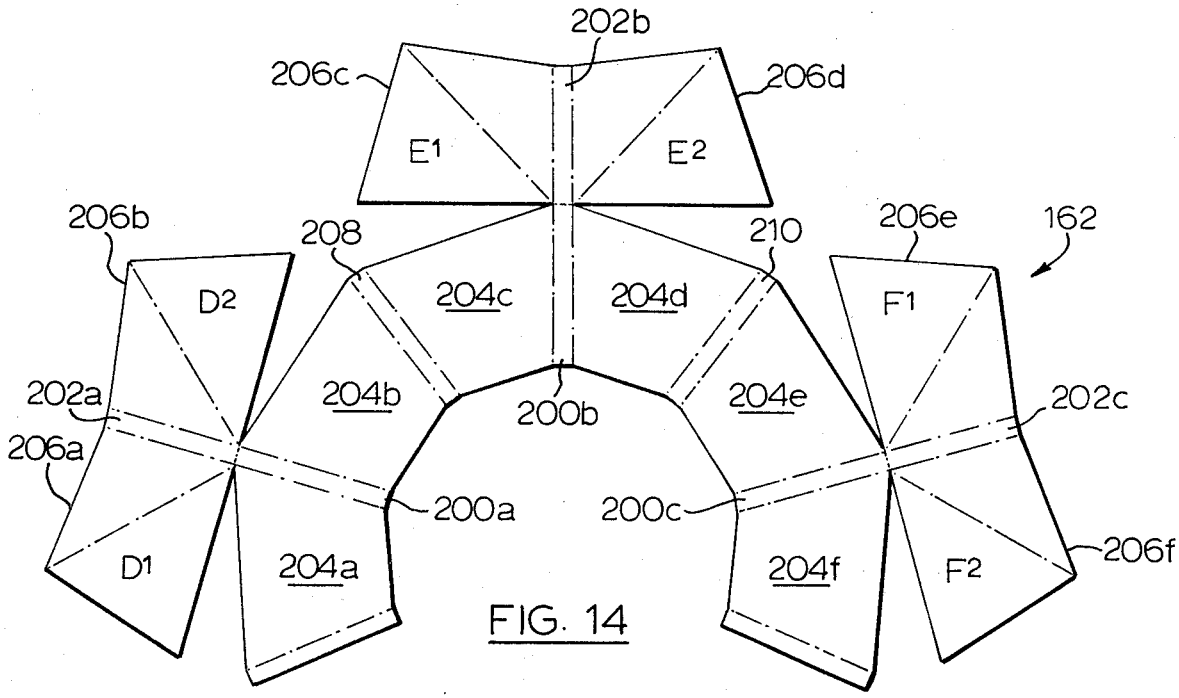
FIG. 14 is still another plan view of a flattened sheet of suitable material, having a perimetral configuration and integral fold axes from which multiple units patterned on embodiment of FIGS. 9 to 11 inclusive may be derived.

The layout 162 of FIG. 14 includes multiples of the unit disclosed in FIGS. 9 to 11 inclusive.

The central inclined panels 200*a*, 200*b* and 200*c* are of elongated, rectangular configuration.

Likewise, upstanding rear panels 202*a*, 202*b*, 202*c* are elongated and of rectangular outline.

Flanking each central inclined panel are pairs of inclined side panels, 204*a* 204*b*, 204*c* 204*d*, and 204*e* 204*f* respectively, each joined to its respective central panel along their common edges for swinging movement which define fold axes already described.

Each of upstanding rear panels are likewise flanked by side panels 206*a* 206*b*, 206*c* 206*d*, and 206*e* 206*f* respectively and each provided with diagonal fold lines, all shown in broken outline to present triangular portions $D^1$ $D^2$, $E^1$ $E^2$, $F^1$ $F^2$, to the corresponding front inclined panel whereby the attachments can be made to secure the multiple unit in independently erect configuration. Adjacent inclined side panels of each unit are joined respectively by double hinge fold axes as at 208 and 210.

It will be appreciated from the several perspective views of the structures shown in their erect stable configuration that the geometrical forms presented have a regular outline in that each possess an axis of symmetry and include plane figures bounded by straight lines, whether they are quadrilaterals or triangles which are pleasing to the eye. Moreover, the attractiveness of the support structures can be enhanced by selecting materials that are coloured, or bear patterns or are otherwise decorated.

It will also be understood that by providing support structures of the type disclosed an enclosure can be established, isolating to varying degrees a study station with written works, or books, or pads supported on the inwardly facing inclined surfaces, or merely isolating a study or work station as circumstances may dictate.

While the preferred embodiments of this invention have been described and illustrated, various modifications or alterations may be undertaken by those persons skilled in the art without departing from the spirit and scope of the invention as defined in the appended claims.

What I claim is:

1. In a collapsible support structure, at least four substantially rigid hingedly interconnected sheet-like panels adapted to be self-sustaining when erected to sit upon a flat surface, including a front central panel having a top side and bottom edges flanked by a pair of front side panels, each having top side and bottom edges and a rear central panel having top side and bottom edges, means hingedly connecting said front central panel to said rear central panel only adjacent their top edges to define a fold axis spaced from and parallel to their respective bottom edges whereby with said front and rear central panel swung apart about their common fold axis their bottom edges may be presented in spaced apart surface engaging relation, means hingedly connecting each said front side panel to said front central panel only along their next adjacent side edges to define therewith a pair of spaced apart fold axes, the peripheral configuration of each said side panels being such that with the bottom edges of said rear central panel and said front central panel in spaced apart surface engaging relation, the bottom edge of each said side panel registers in surface engaging relation at a limit position reached only when swung about its respective fold axis forwardly to extend angularly outwardly beyond said front central panel, and means for securing each said side panel to said rear central panel to constrain same against further swinging movement about their respective fold axes beyond said limit positions.

2. In a collapsible support structure at least four substantially rigid hingedly interconnected sheet-like panels adapted to be self-sustaining when erected to sit upon a flat surface, including a front central panel having top, side and bottom edges flanked by a pair of front side panels, each having top, side and bottom edges and a rear central panel having top, side and bottom edges, means hingedly connecting said front central panel to said rear central panel, only adjacent their top edges to define a fold axis spaced from and parallel to the respective bottom edges, whereby with said front and rear central panels swung apart about their common fold axis their bottom edges are presented in spaced apart surface engaging relation with said front central panel inclined downwardly and forwardly, means hingedly connecting each said front side panels to said front central panel only their next adjacent side edges to define therewith a pair of spaced apart fold axes, the peripheral configuration of each said side panels being such that with the bottom edges of said rear central panel and said downwardly and forwardly inclined front central panel in spaced apart surface engaging relation, the bottom edge of each said side panel registers in surface engaging relation at a limit position reached only when swung about its respective fold axis forwardly to extend angularly outwardly beyond said front central panel and means for securing each said side panel to said rear central panel to constrain same against further swinging movement about their respective fold axes beyond said limit positions.

3. A collapsible support structure according to claim 2 in which the extent of said front central panel measured from said fold axis to its bottom edge is greater than the extent of said rear central panel measured from said fold axis to its bottom edge, whereby with said front and rear central panels swung apart about their common fold axis, said rear central panel is presented substantially upright with its bottom edge in surface engaging relation and said front central panel is inclined downwardly and forwardly with its bottom edge in surface engaging relation.

4. A support structure according to claim 3 wherein said means for securing each side panel to said rear central panel to constrain same against further swinging movement beyond said limit positions includes a pair of substantially rigid sheet-like rear side panels, flanking said rear central panel, each rear side panel having top bottom and side edges, means hingedly connecting each said rear side panel to said rear central panel, only along their next adjacent side edges to define a pair of spaced fold axes, each latter mentioned fold axis lying respectively in a plane, substantially common to the plane of the fold axis of the front side panel to which the rear side panel is adapted to be secured.

5. A support structure according to claim 4 in which each said rear side panel is hingedly connected to its respective front side panel along a fold axis lying substantially in the plane of its respective front side panel and in a direction intersecting with the plane substantially common to the respective fold axes of the front and rear side panels whereby each said rear side panel is adapted to swing with its respective front side panel throughout the range of swinging movement of its respective side panel to its said limit position and reversely.

6. A support structure according to claim 5 in whcih said rear side panel swinging with its respective front side panel is in the form of a gusset whose bottom edge registers in surface engaging relation only when its respective front side panel reaches its said limit position.

7. A support structure according to claim 4 wherein said panels are constituted by integral portions of the same sheet.

8. A support structure according to claim 4 wherein the side-edge to side-edge extent of said front central panel exceeds the side-edge to side-edge extent of each said front side panel, whereby said front side panels are each swingable into overlying relation with said front central panel and with each other.

9. A support structure according to claim 4 wherein each said panel is an integral portion of the same sheet and wherein the fold axes hingedly connecting said side panels to their respective central panels are defined by a spaced substantially parallel score lines of like separation to thereby provide a double hinge formation.

10. A support structure according to claim 5 wherein the bottom edges of all said panels lie in co-planar relation when said front side panel edges reach said limit positions.

11. A support structure according to claim 5 wherein the portion of said rear side panel extending beyond said second mentioned fold axis lying substantially in the plane of its respective front side panel is secured in that region to said front side panel to reinforce and support same.

12. A support structure according to claim 4 wherein a surface engageable panel is hingedly connected along the bottom edge of said front central panel to swing forwardly thereof and to extend between said flanking side panels in surface engaging relation in the erect self-sustaining configuration of said support structure and means for releasably securing said surface engageable panel to each of said flanking side panels respectively with said side panels in said limit positions.

* * * * *